US009302874B2

(12) United States Patent
Schilling et al.

(10) Patent No.: US 9,302,874 B2
(45) Date of Patent: Apr. 5, 2016

(54) APPARATUS FOR OVERLAPPING AND STACKING SHEETS

(71) Applicants: Andreas Schilling, Lichtenstein (DE); Hansjoerg Klein, Aichwald (DE); Markus Kremer, Neuffen (DE)

(72) Inventors: Andreas Schilling, Lichtenstein (DE); Hansjoerg Klein, Aichwald (DE); Markus Kremer, Neuffen (DE)

(73) Assignee: bielomatik LEUZE GMBH & CO. KG, Neuffen (DE)

( * ) Notice: Subject to any disclaimer, the term of this patent is extended or adjusted under 35 U.S.C. 154(b) by 0 days.

(21) Appl. No.: 14/391,992

(22) PCT Filed: Mar. 25, 2013

(86) PCT No.: PCT/EP2013/056248
§ 371 (c)(1),
(2) Date: Oct. 22, 2014

(87) PCT Pub. No.: WO2013/160045
PCT Pub. Date: Oct. 31, 2013

(65) Prior Publication Data

US 2015/0069696 A1 Mar. 12, 2015

(30) Foreign Application Priority Data

Apr. 27, 2012 (DE) ..... 10 2012 207 064

(51) Int. Cl.

| | |
|---|---|
| ***B65H 29/68*** | (2006.01) |
| ***B65H 29/66*** | (2006.01) |
| ***B65H 29/24*** | (2006.01) |
| ***B65H 29/32*** | (2006.01) |
| ***B65H 29/62*** | (2006.01) |
| ***B65H 31/38*** | (2006.01) |

(52) U.S. Cl.
CPC ..... *B65H 29/242* (2013.01); *B65H 29/245* (2013.01); *B65H 29/246* (2013.01); *B65H 29/32* (2013.01); *B65H 29/62* (2013.01); *B65H 29/6627* (2013.01); *B65H 29/686* (2013.01); *B65H 31/38* (2013.01); *B65H 2301/4212* (2013.01); *B65H 2404/63* (2013.01); *B65H 2404/693* (2013.01); *B65H 2406/13* (2013.01); *B65H 2406/323* (2013.01); *B65H 2406/3221* (2013.01); *B65H 2406/363* (2013.01)

(58) Field of Classification Search
CPC .. B65H 29/68; B65H 29/686; B65H 29/6627; B65H 29/246; B65H 29/248; B65H 29/242; B65H 29/32
See application file for complete search history.

(56) References Cited

U.S. PATENT DOCUMENTS

| | | | |
|---|---|---|---|
| 3,941,374 | A | 3/1976 | Vitz |
| 5,611,529 | A | 3/1997 | Richarz |

FOREIGN PATENT DOCUMENTS

| | | | |
|---|---|---|---|
| GB | 985227 A | * | 3/1965 |
| GB | 1109130 A | * | 4/1968 |
| JP | 2004043106 B | | 2/2004 |

* cited by examiner

*Primary Examiner* — Luis A Gonzalez
(74) *Attorney, Agent, or Firm* — Andrew Wilford

(57) ABSTRACT

An apparatus for overlapping sheets and depositing them in a stack has a conveyor for transporting the sheets in a horizontal travel direction along a travel path toward a stacking region at a rapid feed speed. A braking device on the path upstream of the stacking region can grip the trailing edge of a one of the sheets. At least one supporting air bar extends above the path into the stacking region and has nozzles from which compressed air exits in the sheet travel direction. A suction belt above the travel path between the braking device and the stacking region is movable in the travel direction at least at the rapid feed speed and has suction ports that can be switched on and off cyclically.

9 Claims, 1 Drawing Sheet

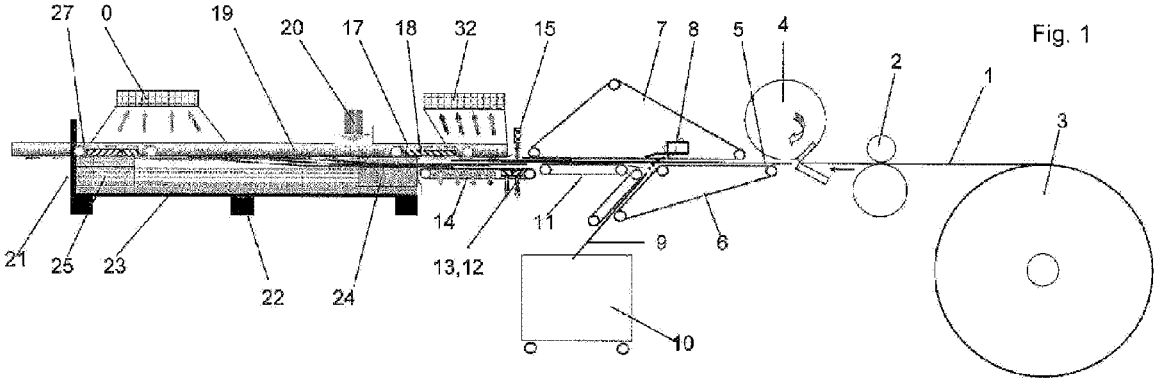
Fig. 1
Fig. 2
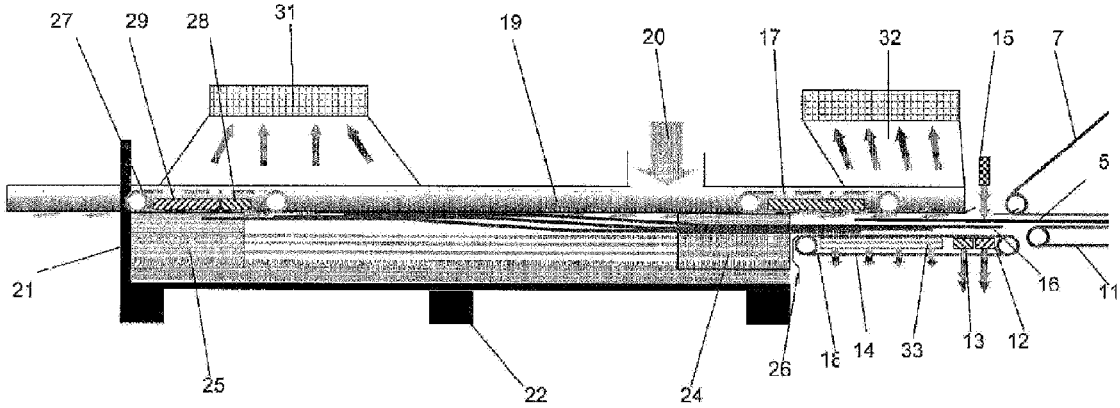
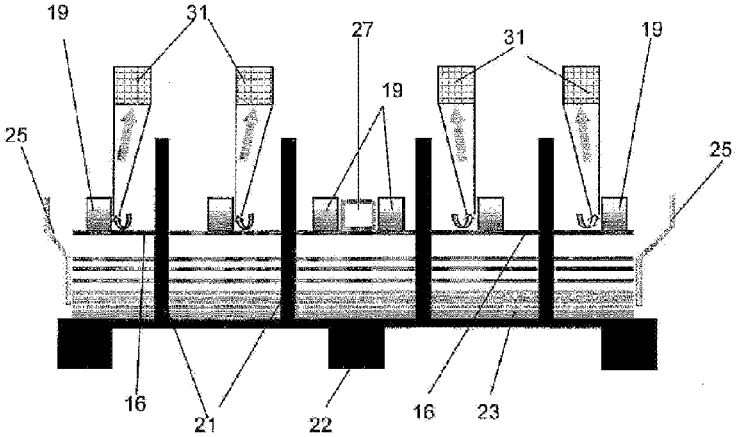
Fig. 3

APPARATUS FOR OVERLAPPING AND STACKING SHEETS

CROSS REFERENCE TO RELATED APPLICATIONS

This application is the US-national stage of PCT application PCT/EP2013/056248 filed 25 Mar. 2013 and claiming the priority of German patent application 102012207064.8 itself filed 27 Apr. 2012.

FIELD OF THE INVENTION

The invention relates to an apparatus for overlapping sheets and depositing them in a stack.

BACKGROUND OF THE INVENTION

Such an apparatus has a braking device upstream of the stacking region and acts on each of the trailing edges of the sheet as they are fed in, and at least one supporting bar that extends above the travel plane in the stacking region and has nozzles from which compressed air exits.

An apparatus of this type is described in WO 1994/025384 [U.S. Pat. No. 5,611,529]. Apparatuses of this type are used for stacking sheets downstream of machines with continuous transport of individual sheets, such as cross-cutting machines or printing presses. In a first step, they produce an overlapped stream from the sheets conveyed in one after another, which overlapped stream is subsequently deposited in a stack. Here, the length of the sheets usually deposited on pallets can be considerably greater than the sheet width and can be 1 m and more.

The apparatus described in WO 1994/025384 is of very compact construction. Its length between the braking device and the start of the stacking region is less than the maximum sheet length that can be processed.

OBJECT OF THE INVENTION

The invention is based on the object of improving an apparatus of compact construction of the generic type in such a way that it can also deposit sheets of sensitive papers at high speed.

SUMMARY OF THE INVENTION

This object is achieved in that the nozzles of the supporting air bars above the stacking region are designed in such a way that compressed air exits in the sheet travel direction. As a result, a partial vacuum is produced in the region of the nozzles and pulls the sheet onto the supporting air bar with a low force. At the same time, the compressed air that flows out exerts a force on the sheet in the travel direction. A suction belt is above the travel plane in the region between the braking device and the stacking region. The suction belt can be moved in the travel direction at the rapid feed speed and its vacuum can be switched on and off cyclically.

The features cause the leading sheet to be pulled forward at its leading edge and to thus be held in a taut manner both in the region of the braking device during the formation of the overlapped stream and in the stacking region. When the sheet trailing edge has reached the region of the braking device, the vacuum is switched off, so that the sheet moves downward, in order to be deposited onto the preceding sheet in the overlapped stream.

In order that the vacuum in the suction belt between the braking device and the stacking region can be dissipated as rapidly as possible, the suction belt is preferably connected additionally to a positive pressure source activated after the suction is switched off.

In order that the leading edges of sensitive sheets do not move over the sheets that have already been deposited during forward movement on the stack in the stacking region and are compressed or damaged in this way, a second suction belt that extends in the travel direction and can be loaded with vacuum is at the end of the stacking region upstream of the leading edge stop. The suction belt preferably moves at the speed of the overlapped stream and has two suction zones one after another in the travel direction, in order that a lower suction than previously can be set at the stop end. This prevents the sheet leading edge from being moved with excessive force against the leading edge stops and avoids damage to the sheet leading edge being produced as a result.

Additional suction bars that extend in next to the respective supporting air bars and assist the supporting action of the installed supporting air bars are preferably provided in the upstream stacking region. The insufficient supporting action of the supporting air bars can be supplemented effectively, in particular, in the region of the overlapped sheet stream.

The braking device is advantageously designed in such a way that a suction box connected to a vacuum source and has suction openings on its upper side is below the travel plane, which suction openings can be opened and closed cyclically. The braking device preferably comprises two suction boxes provided one after another in the travel direction and can be activated cyclically independently of one another. This arrangement makes it possible to switch off the upstream suction box in the travel direction at an early stage, and thus to avoid accidental attraction by suction of the following, rapid sheet. As a result of the arrangement of the second suction chamber, the sheet can be attracted by strong suction over a relatively long time period and distance. This effect is advantageous, in order to protect the sheet from the pulling forces of the supporting bars.

A downwardly blowing blower nozzle above the suction box and above the travel plane assists the downward movement of the sheet trailing edge, by pressing it onto the suction box.

BRIEF DESCRIPTION OF THE DRAWING

The drawing shows the invention with reference to one illustrated embodiment shown in simplified form. In the drawing:

FIG. 1 is a diagrammatic side view of a cross-cutter having an apparatus for overlapping and depositing sheets, FIG. 2 is an enlarged view of a detail from FIG. 1 with the apparatus for overlapping and depositing sheets, and FIG. 3 is an end view of the stacking region viewed against the travel direction.

SPECIFIC DESCRIPTION OF THE INVENTION

The cross-cutter shown in the figures serves to produce paper or cardboard sheets from a continuously fed web 1. The product web 1 is supplied through a feed roller 2 from a reel 3 in an unrolling device. The feed rollers 2 are followed by a cross-cutting device 4 that comprises an upper knife drum, fitted circumferentially with a cross-cutting blade, and a lower stationary blade. Two rotating knife drums can also be used. While running through between the two blades of the cross-cutting device 4, the web 1 is divided into individual sheets 5. The sheets 5 are received by belts 6, 7 above and below the travel plane and convey at a somewhat elevated speed, in order to hold the sheets 5 taut. A sheet deflector 8 that serves to reject defective sheets 9 is provided in the region of the take-off belts 6, 7. The sheet deflector leads to a container 10 in which the defective sheets 9 are collected. Downstream of the sheet deflector 8, the sheets 5 are guided between a further lower belt 11 and the upper take-off belts 7 to the braking device that is downstream and, as part of an overlapping device, produces from the sheets an overlapped stream that is subsequently deposited in a stack.

The braking device comprises at least one suction box below the travel plane and that has suction openings on the upper side that can be opened and closed cyclically in order to draw down a sheet trailing edge by suction. In the illustrated embodiment, the braking device comprises two suction boxes 12, 13 one after another in the travel direction and that are surrounded by slow perforated belts 14 that run at the braked speed. The suction openings of the suction boxes 12, 13 can be opened and closed cyclically, in order to pull the trailing edge of a sheet downward onto the slowly running belt 14. Here, the sheet is braked to the depositing speed.

A downwardly blowing blower nozzle 15 is above the suction boxes 12, 13 and above the travel plane and presses the sheet trailing edge downward onto the suction box 12 a pronounced air flow. The blowing air of the blower nozzle 15 can be switched on and off cyclically, in order that the leading edge of the following sheet 5 can be pushed over the trailing edge of the preceding sheet 16 in the switched-off state. The two suction boxes 12, 13 can be activated cyclically independently of one another. This makes it possible to switch off the suction in the downstream suction box 12, while the suction in the upstream suction box 13 is still active. The leading edge of the sheet 5 that subsequently enters therefore moves without disruption over the trailing edge of the preceding sheet 16.

At least one circulating suction belt 17 is above the travel plane so as to extend in the travel direction in the region between the braking device formed by the suction boxes 12, 13 and the stacking region. A plurality of parallel suction belts 17 are preferably arranged transversely spaced from one another. The suction belts 17 each pass around a respective suction box 18 that builds up a vacuum that pulls the sheets upward. In order to switch a vacuum on and off again selectively in a very rapid manner, the suction boxes 18 are connected both to a subatmospheric and superatmospheric pressure source.

Supporting air bars 19 pull the leading edge of a newly entering sheet 5 upward and hold it there as it is transported reliably at high speed over the sheet stream that is already braked and overlapped. The circulating suction belt 17 makes possible exact control of the movement speed and position of the newly entering sheet 5 after its trailing edge has left the belts 7 and 11.

Additional flat suction nozzles 32 opening downward apply additional suction to the sheet upper face between the suction belts 17 and the supporting air bars 19 in order to reinforce the holding effect.

The leading edges of the sheet 16 that have already been overlapped are conveyed into the stacking region in a floating manner by the supporting air bars 19 and suction nozzles 31. After they leave the suction zones 12, 13, the trailing edges of the overlapped sheets 16 are pass over a further suction zone 33 and are transported as far as into the depositing region to upstream aligning elements 26. In the case of certain papers, depositing can also take place without the second suction zone 33. Depositing onto the stack in that case follows directly after the suction zone 13.

Supporting parallel air bars 19 that can be adjusted transversely extend through the respective stacking region for transporting a sheet into the stacking region. These supporting air bars 19 have downwardly directed nozzles that emit compressed air supplied by a compressed air source 20. The nozzles of each supporting air bar 19 are designed in such a way that compressed air exits in the sheet travel direction and in this way, as shown in FIG. 3, conveys a sheet 16 with its leading edge against stops 21 that stop it. The stops 21 align the sheet leading edge. The stopped sheets 16 fall onto the upper surface of the stack 23 that rests on a pallet 22 as they are being aligned laterally by aligning elements 24, 25. The alignment of the trailing edge is effected by a transversely extending aligning element 26 oscillated just like the lateral aligning elements 24, 25.

A further suction belt 27 that extends in the travel direction is above the travel plane at the downstream end of the stacking region and in the center thereof upstream of the end stops 21, which suction belt 27 can be depressurized. The suction belt 27 preferably has two suction zones one after another in the travel direction and formed by suction chambers 28, 29 that can be at different subatmospheric pressures. The suction chambers 28, 29 are surrounded by the suction belt 27, a more pronounced vacuum being applied by the downstream suction chamber 28 than by the upstream suction chamber 29. This makes it possible to reduce the conveying force on a sheet 16 immediately before the stops 21 are reached.

In order to prevent premature and uncontrolled falling of a sheet 16 from the travel plane in the stacking region, additional suction bars 31 are arranged next to the respective supporting air bars 19, which additional suction bars 31 each have a slot-shaped suction opening that extends next to the supporting air bars 19 and together build up a large-area vacuum that acts on the upper face of the leading edge of an entering sheet 16.

The invention claimed is:

1. An apparatus for overlapping sheets and depositing them in a stack, the apparatus comprising:

conveyor means for transporting the sheets in a horizontal travel direction along a travel path toward a stacking region at a rapid feed speed;

a braking device on the path upstream of the stacking region and capable of gripping the trailing edge of a one of the sheets;

at least one supporting air bar that extends above the path into the stacking region and has nozzles from which compressed air exits in the sheet travel direction;

a suction belt above the travel path between the braking device and the stacking region, movable in the travel direction at least at the rapid feed speed, and having suction ports that can be switched on and off cyclically; and a selectively switchable vacuum source and a selectively switchable positive pressure source connected to the suction belt.

2. The apparatus as claimed in claim 1, wherein the braking device comprises a suction box below the travel path and has on its upper side suction openings that can be opened and closed cyclically.

3. The apparatus as claimed in claim 2, further comprising:

a downwardly blowing blower nozzle above the suction box and above the travel path, in order to press a sheet trailing edge downward onto the suction box.

4. The apparatus as claimed in claim 1, further comprising:

a suction nozzle directly over the overlapping region and exerting an additional holding force on the sheet leading edge and upper side of a sheet, while the sheet moves over the overlapping region at the high feed speed.

5. An apparatus for overlapping sheets and depositing them in a stack, the apparatus comprising:

conveyor means for transporting the sheets in a horizontal travel direction along a travel path toward a stacking region at a rapid feed speed;

a braking device on the path upstream of the stacking region and capable of gripping the trailing edge of a one of the sheets;

at least one supporting air bar that extends above the path into the stacking region and has nozzles from which compressed air exits in the sheet travel direction;

a suction belt above the travel path between the braking device and the stacking region, movable in the travel direction at least at the rapid feed speed, and having suction ports that can be switched on and off cyclically;

a stop for the sheet leading edges at a downstream end of the stacking region; and at least one suction belt that extends in the travel direction and can be depressurized above the travel path upstream of the stop.

6. The apparatus as claimed in claim 5, wherein the suction belt is connected both to a vacuum source and to a positive pressure source for selectively switching the suction on and off.

7. The apparatus as claimed in claim 5, wherein the suction belt has two suction zones one after another in the travel direction that can be differently depressurized.

8. An apparatus for overlapping sheets and depositing them in a stack, the apparatus comprising:

conveyor means for transporting the sheets in a horizontal travel direction along a travel path toward a stacking region at a rapid feed speed;

a braking device comprising two suction boxes below the travel path upstream of the stacking region one after another in the travel direction, having upwardly open suction openings that can be opened and closed cyclically independently of one another;

at least one supporting air bar that extends above the path into the stacking region and has nozzles from which compressed air exits in the sheet travel direction; and a suction belt above the travel path between the braking device and the stacking region, movable in the travel direction at least at the rapid feed speed, and having suction ports that can be switched on and off cyclically.

9. An apparatus for overlapping sheets and depositing them in a stack, the apparatus comprising:

conveyor means for transporting the sheets in a horizontal travel direction along a travel path toward a stacking region at a rapid feed speed;

a braking device on the path upstream of the stacking region and capable of gripping the trailing edge of a one of the sheets;

at least one supporting air bar that extends above the path into the stacking region and has nozzles from which compressed air exits in the sheet travel direction;

a suction belt above the travel path between the braking device and the stacking region, movable in the travel direction at least at the rapid feed speed, and having suction ports that can be switched on and off cyclically; and additional suction bars in the stacking region and each extending next to a respective one of the supporting air bars in order to prevent uncontrolled falling of a sheet.

* * * * *